US008624410B2

(12) United States Patent
Sardo

(10) Patent No.: US 8,624,410 B2
(45) Date of Patent: Jan. 7, 2014

(54) ELECTRICITY GENERATION DEVICE WITH SEVERAL HEAT PUMPS IN SERIES

(75) Inventor: Alberto Sardo, Chateaurenard (FR)

(73) Assignee: Xeda International, Saint Andiol (FR)

( * ) Notice: Subject to any disclaimer, the term of this patent is extended or adjusted under 35 U.S.C. 154(b) by 84 days.

(21) Appl. No.: 13/141,057

(22) PCT Filed: Dec. 18, 2009

(86) PCT No.: PCT/FR2009/052615

§ 371 (c)(1),
(2), (4) Date: Sep. 8, 2011

(87) PCT Pub. No.: WO2010/070242

PCT Pub. Date: Jun. 24, 2010

(65) Prior Publication Data

US 2011/0309635 A1 Dec. 22, 2011

(30) Foreign Application Priority Data

Dec. 19, 2008 (FR) ..... 08 58836

(51) Int. Cl.
*F03B 17/04* (2006.01)

(52) U.S. Cl.
USPC ..... 290/1 A; 60/651

(58) Field of Classification Search
USPC ..... 290/1 A; 415/916; 62/476, 499; 165/104.12, 112, 480
See application file for complete search history.

(56) References Cited

U.S. PATENT DOCUMENTS

| | | | | |
|---|---|---|---|---|
| 4,724,679 | A * | 2/1988 | Radermacher | 62/101 |
| 5,042,259 | A * | 8/1991 | Jones | 62/46.2 |
| 2005/0076639 | A1 | 4/2005 | Shirk | |
| 2008/0127657 | A1 * | 6/2008 | Fang et al. | 62/79 |

FOREIGN PATENT DOCUMENTS

| | | | |
|---|---|---|---|
| DE | 3433366 | A1 | 3/1986 |
| DE | 19925257 | A1 | 2/2001 |
| DE | 102004006837 | A1 | 8/2005 |
| GB | 2016668 | A | 9/1979 |

OTHER PUBLICATIONS

International Search Report and Written Opinion, International Application No. PCT/FR2009/052615 dated Mar. 21, 2011.

* cited by examiner

*Primary Examiner* — Thomas Denion
*Assistant Examiner* — Shafiq Mian
(74) *Attorney, Agent, or Firm* — Knobbe Martens Olson & Bear, LLP

(57) ABSTRACT

The device for generating electricity (1) comprises:

a first heat pump (3) provided with a first closed circuit (15) in which a first heat-transfer fluid circulates, and with a first heat exchanger (17) between the first heat-transfer fluid and a flow of atmospheric air in which the flow of atmospheric air transfers a quantity of heat to the first heat-transfer fluid, at least a second heat pump (5), provided with a second closed circuit (23) in which a second heat-transfer fluid circulates, and with a second heat exchanger (25) between the second heat-transfer fluid and a third heat-transfer fluid in which the second heat-transfer fluid transfers a quantity of heat to the third heat-transfer fluid;

means for transferring a quantity of heat from the first heat-transfer fluid to the second heat-transfer fluid;

a third closed circuit (9), in which the third heat-transfer fluid circulates;

a turbine (11) inserted on the third closed circuit (9) and driven by the third heat-transfer fluid;

an electric generator (13), mechanically driven by the turbine (11).

12 Claims, 1 Drawing Sheet

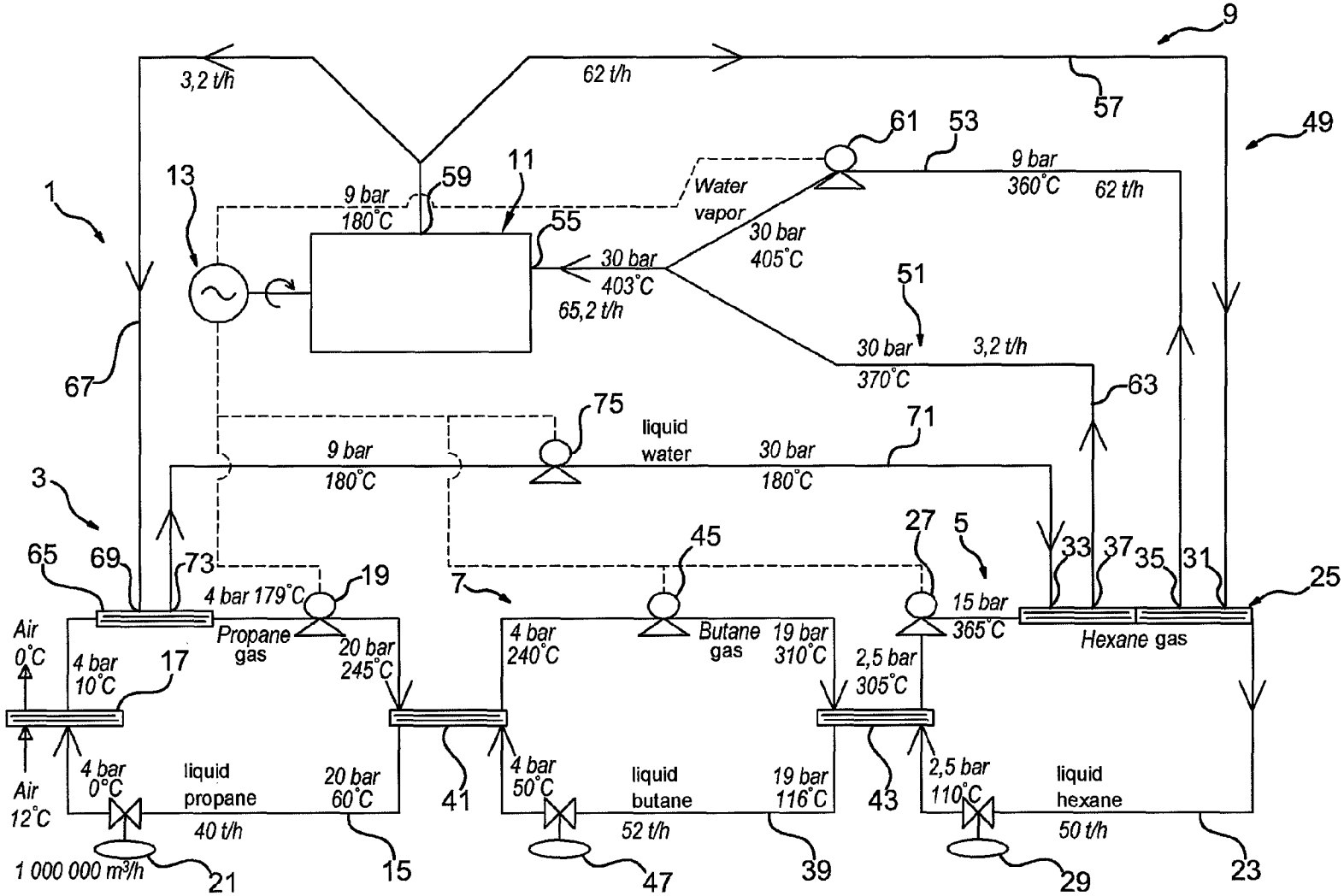
Hexane gas
liquid hexane
50 t/h
62 t/h
9 bar
360°C
3,2 t/h
15 bar
365°C
2,5 bar
110°C
2,5 bar
305°C
30 bar
370°C
30 bar
405°C
30 bar
180°C
19 bar
310°C
19 bar
116°C
Butane gas
liquid butane
52 t/h
Water vapor
liquid water
30 bar
403°C
65,2 t/h
4 bar
240°C
4 bar
50°C
9 bar
180°C
9 bar
180°C
20 bar
245°C
20 bar
60°C
4 bar 179°C
Propane gas
liquid propane
40 t/h
4 bar
10°C
4 bar
0°C
Air
0°C
Air
12°C
1 000 000 m³/h
62 t/h
3,2 t/h

ELECTRICITY GENERATION DEVICE WITH SEVERAL HEAT PUMPS IN SERIES

The invention generally concerns devices for generating electricity.

The devices known to date for generating electricity contribute towards global warming (fossil or biomass fuel production) or they are neutral with respect to global warming (hydraulic plants, wind farms, nuclear plants). Electricity generating devices operating with solar energy contribute towards reducing global warming by converting solar energy to electric energy. However, said solar energy installations are generally not very powerful, since the heat of the sun is only available at low temperature. For a rise in temperature, it is necessary to concentrate the sun's rays which is technically complex.

Solar energy is therefore useful for heating water or air, but it is ill-adapted for the mass production of electric energy. Photovoltaic cells at the present time are only able to provide small quantities of electric energy.

Also, it is known that heat pumps allow the production of heat at a higher temperature than ambient air. Heat pumps absorb energy from ambient air and output heat with a temperature difference generally of the order of 30 to 40° C. relative to ambient air. Said machines are not adapted for the production of electric energy owing to the low difference in temperature between the hot and cold points of heat pumps.

Within this context, the invention sets out to propose a device for generating electricity which contributes towards limiting global warming and allows the production of large quantities of electricity with acceptable efficiency.

For this purpose, the invention relates to a device for generating electricity of the type comprising:

- a first heat pump, provided with a first closed circuit in which a first heat-transfer fluid circulates, and a first heat exchanger between the first heat-transfer fluid and a flow of atmospheric air, in which the flow of atmospheric air transfers a quantity of heat to the first heat-transfer fluid;
- at least one second heat pump provided with a second closed circuit in which a second heat-transfer fluid circulates, and with a second heat exchanger between the second heat-transfer fluid and a third heat-transfer fluid, in which the second heat-transfer fluid transfer a quantity of heat to the third heat-transfer fluid;
- means for transferring a quantity of heat from the first heat-transfer fluid to the second heat-transfer fluid;
- a third closed circuit in which the third heat-transfer fluid circulates;
- a turbine inserted in the third closed circuit and driven by the third heat-transfer fluid;
- an electric generator mechanically driven by the turbine.

The generation device may also have one or more of the characteristics below, taken alone or in any technically possible combination:

- the means for transferring a quantity of heat from the first heat-transfer fluid to the second heat-transfer fluid comprise a third heat pump provided with a fourth closed circuit in which a fourth heat-transfer fluid circulates, with a third heat exchanger between the first heat-transfer fluid and the fourth heat-transfer fluid in which the first heat-transfer fluid yields a quantity of heat to the fourth heat-transfer fluid, and with a fourth heat exchanger between the fourth heat-transfer fluid and the second heat-transfer fluid in which the fourth heat-transfer fluid yields a quantity of heat to the second heat-transfer fluid;

- the first heat-transfer fluid, at an inlet of the third heat exchanger, has a pressure of between 18 and 22 bars and a temperature of between 220 and 270° C., the first heat-transfer fluid having at an inlet of the first heat exchanger a pressure of between 2 and 6 bars and a temperature of between 0 and 20° C.;
- the fourth heat-transfer fluid, at an inlet of the fourth heat exchanger, has a pressure of between 17 and 22 bars and a temperature of between 290 and 330° C., the fourth heat-transfer fluid having at an inlet of the third heat exchanger a pressure of between 2 and 6 bars and a temperature of between 30 and 70° C.;
- the second heat-transfer fluid, at an inlet of the second heat exchanger, has a pressure of between 13 and 17 bars and a temperature of between 340 and 390° C., the second heat-transfer fluid having at an inlet of the fourth heat exchanger a pressure of between 1 and 5 bars and a temperature of between 90 and 130° C.;
- the third closed circuit comprises first and second loops in which the third heat-transfer fluid circulates, each of the first and second loops having a hot line connecting an outlet of the second heat exchanger with a high pressure inlet of the turbine, the first loop having a first feedback line connecting a low pressure outlet of the turbine to an inlet of the second heat exchanger, the second loop having an intermediate heat exchanger between the first heat-transfer fluid and the third transfer-fluid in which the third heat-transfer fluid yields a quantity of heat to the first heat-transfer fluid, an intermediate line connecting a low pressure outlet of the turbine to an inlet of the intermediate heat exchanger, and a second feedback line connecting an outlet of the intermediate exchanger with an inlet of the second heat exchanger;
- the first heat-transfer fluid essentially comprises propane;
- the second heat-transfer fluid essentially comprises hexane;
- the fourth heat-transfer fluid essentially comprises butane;
- the third heat-transfer fluid essentially comprises water.

Other characteristics and advantages of the invention will become apparent from the detailed description given below as an illustration which is in no way limiting, with reference to the appended single figure schematically illustrating a device for generating electricity conforming to the invention.

The device shown in the appended figure is intended for the generation of electricity. It comprises a steam turbine, inserted in a water/steam circuit, the heat required to supply water steam at high pressure to the turbine being obtained via several heat pumps placed in series. Therefore, the heat needed for the production of high pressure steam is essentially taken from the atmosphere.

More precisely, the device for generating electricity comprises:

- first, second and third heat pumps 3, 5 and 7;
- a water/steam circuit 9;
- a steam turbine 11 inserted in the water/steam circuit 9;
- an electric generator 13, mechanically driven by the turbine 11.

The first heat pump 3 comprises a first closed circuit 15 in which a first heat-transfer circulates, a first heat exchanger 17 between the first heat-transfer fluid and atmospheric air, a compressor 19 and an expansion valve 21.

The first heat-transfer fluid essentially comprises propane. Advantageously, the first heat-transfer fluid is technically pure propane.

The first heat exchanger 17 comprises a first side in which atmospheric air circulates, and a second side in which propane circulates. Preferably, the device comprises means for forcing the circulation of air on the first side of the heat exchanger 17. These means may comprise fans for example or any type of similar equipment.

The second heat pump 5 comprises a second closed circuit 23 in which a second heat-transfer fluid circulates, a second heat exchanger 25 between the second heat-transfer fluid and the fluid circulating in the water/steam circuit 9, a compressor 27 and an expansion valve 29.

The second heat-transfer fluid essentially comprises hexane. For example, the second heat-transfer fluid is technically pure hexane.

The second heat exchanger 25 comprises a first side in which the second heat-transfer fluid circulates, and a second side in which water circulates in liquid or steam form. The water forms a third heat-transfer fluid.

The water circulating in the water/steam circuit 9 enters the heat exchanger 25 in steam form via inlet 31 and in liquid form via inlet 33, receives the heat yielded by the second heat-transfer fluid, and leaves the heat exchanger 25 in the form of steam via outlets 35 and 37.

The third heat pump 7 comprises a third closed circuit 39 in which a fourth heat-transfer circulates, a third heat exchanger 41 between said fourth heat-transfer fluid and the first heat-transfer fluid of the first heat pump 3, a fourth heat exchanger 43 between said fourth heat-transfer fluid and the second heat-transfer fluid of the second heat pump 5, a compressor 45 and an expansion valve 47. The heat exchanger 41 has a first side in which the first heat-transfer fluid circulates, and a second side in which the fourth heat-transfer fluid circulates.

The fourth heat exchanger 43 has a first side in which the fourth heat-transfer fluid circulates, and a second side in which the second heat-transfer fluid circulates.

The fourth heat-transfer fluid preferably essentially comprises butane. For example, the fourth heat-transfer fluid is technically pure butane.

The water/steam circuit 9 comprises first and second loops 49 and 51. The same heat-transfer fluid circulates in both loops.

The first loop 49 comprises a first hot line 53 connecting the steam outlet 35 of the second heat exchanger with a high pressure inlet 55 of the turbine 11. The first loop also comprises a feedback line 57 connecting a low pressure outlet 59 of the turbine with the steam inlet 31 of the second heat exchanger. The first loop 49 also comprises a compressor 61 inserted on the first hot line 53.

The second loop 51 of the water/steam circuit comprises a second hot line connecting the second steam outlet 37 of the heat exchanger 25 with the high pressure inlet 55 of the steam turbine.

The second loop further comprises an intermediate heat exchanger 65 between the first heat-transfer fluid and the third heat-transfer fluid, an intermediate line 67 connecting the low pressure outlet 59 of the steam turbine with an inlet 69 of the intermediate exchanger, and a second feedback line connecting an outlet 73 of the intermediate exchanger with the liquid inlet 33 of the second heat exchanger 25. The second loop also comprises a compressor 75 inserted on the feedback line 71.

The intermediate exchanger 65 comprises a first side in which the first heat-transfer fluid circulates, and a second side in which the third heat-transfer fluid circulates, from inlet 69 as far as outlet 73.

The closed circuit 15 connects a discharge outlet of the compressor 19 with an inlet of the first side of the heat exchanger 41. The circuit 15 also connects the outlet of said first side with the inlet of the expansion valve 21. The outlet of the expansion valve 21 is connected by the circuit 15 with an inlet of the second side of the heat exchanger 17. The circuit also connects the outlet of the second side of exchanger 17 with the inlet of the first side of exchanger 65 and the outlet of the first side of exchanger 65 with the suction of the compressor 19.

The first heat-transfer fluid is gaseous between the outlet of exchanger 17 and the inlet of exchanger 41. It is liquid between the outlet of exchanger 41 and the inlet of exchanger 17. In exchanger 17, the first heat-transfer fluid is in thermal contact with the air circulating on the first side of this exchanger. The air imparts heat to the first heat-transfer fluid. The first heat-transfer fluid is vaporised when passing through the first heat exchanger 17.

In the intermediate exchanger 65, the first heat-transfer fluid circulating on the first side of the exchanger is in thermal contact with the steam circulating on the second side of the exchanger. The steam is at least partly condensed when passing through the intermediate exchanger and transfers heat to the first heat-transfer fluid.

The first heat-transfer fluid circulating on the first side of heat exchanger 41 is in thermal contact with the fourth heat-transfer fluid circulating on the second side of exchanger 41. The first heat-transfer fluid is condensed when passing through the exchanger 41 and transfers heat to the third heat-transfer fluid.

The third closed circuit 39 connects the discharge of the compressor 45 with an inlet on the first side of heat exchanger 43. It also connects the outlet of said first side of heat exchanger 43 with an inlet of the expansion valve 47. The closed circuit 39 also connects the outlet of the expansion valve 47 with an inlet of the second side of heat exchanger 41. Finally, the circuit 39 connects an outlet of said second side of exchanger 41 with the suction of the compressor 45.

As indicated above, the fourth heat-transfer fluid is in thermal contact with the first heat-transfer fluid when passing through heat exchanger 41 from which it receives heat. The fourth heat-transfer fluid is vaporised in heat exchanger 41. The fourth heat-transfer fluid when passing through the first side of heat exchanger 43 is in thermal contact with the second heat-transfer fluid circulating on the second side of exchanger 43. The fourth heat-transfer fluid is condensed when passing through heat exchanger 43 and transfers heat to the second heat-transfer fluid.

The fourth heat-transfer fluid is in the gaseous state between the outlet of the second side of heat exchanger 41 and the inlet of the first side of heat exchanger 43. It is in the liquid state between the outlet of the first side of exchanger 43 and the inlet of the second side of exchanger 41.

The second closed circuit 23 connects the discharge of the compressor 27 with an inlet of the first side of heat exchanger 25. It also connects an outlet of the first side of heat exchanger 25 with an inlet of the expansion valve 29. The circuit 23 also connects the outlet of the expansion valve 29 with the inlet of the second side of exchanger 43, and the outlet of said second side with the suction of the compressor 27. The second heat-transfer fluid, when passing through the second side of heat exchanger 43 is in thermal contact with the fourth heat-transfer fluid. It receives heat from the fourth heat-transfer fluid when passing through exchanger 43 and is vaporised.

The second heat-transfer fluid is in thermal contact with the third heat-transfer fluid in heat exchanger 25. When passing through the first side of heat exchanger 25 it is condensed and transfers heat to the third heat-transfer fluid.

The second heat-transfer fluid is in the gaseous state between the outlet of the second side of exchanger 43 and the inlet of the first side of heat exchanger 25. It is in the liquid state between the outlet of the first side of heat exchanger 25 and the inlet of the second side of heat exchanger 43.

The heat exchanger 25 for example is a dual-zone exchanger, a first zone allowing heating of the steam circulating in the first loop and a second zone allowing vaporisation of the water circulating in the second loop. The second heat-transfer fluid circulating on the first side of heat exchanger 25 is first placed in thermal contact with the fluid circulating in the second loop, then placed in thermal contact with the fluid circulating in the first loop. The second side of heat exchanger 25 comprises two separate circuits, one between inlet 33 and outlet 37, and the other between inlet 31 and outlet 35. The fluid in these two circuits is separated.

The water is in steam state in the first loop between the outlet 35 and the high pressure inlet 55 of the turbine. It is in steam state, close to saturation temperature, between the low pressure outlet 59 of the turbine and the inlet 31 of the second heat exchanger. In the second loop, the water is in steam state between the outlet 37 of the second heat exchanger and the high pressure inlet 55 of the turbine. It is in the steam state close to saturation temperature between the low pressure outlet 59 of the turbine and the inlet 69 of the intermediate exchanger 65. The steam is at least partly condensed in the exchanger 65. The water is in liquid form between the discharge of the compressor 75 and the inlet 33 of the second heat exchanger.

The functioning of the above-described device described will now be detailed.

The atmospheric air circulating on the second side of heat exchanger 17 transfers its heat to the first heat-transfer fluid. For example, the atmospheric air has a temperature difference of 12° C. between the inlet and outlet of the exchanger 17. The flow-rate of atmospheric air is approximately 1 million $m^3$/h. For example, the air at the inlet of exchanger 17 has a temperature of 12° C. and a temperature of 0° C. at the outlet of exchanger 17.

The flow-rate of propane in the first closed circuit 15 is about 40 t/h. The propane is vaporised in exchanger 17. It has a pressure of 4 bars and a temperature or about 0° C. at the inlet to exchanger 17 and a temperature of 10° C. at the outlet of exchanger 17. The propane is heated in the intermediate exchanger 65. It has a pressure of 4 bars and a temperature of about 179° C. at the outlet of the intermediate exchanger 65. The propane is compressed by the compressor 19 and has a pressure of 20 bars and a temperature of about 245° C. at the discharge of the compressor 19. When passing through heat exchanger 41 the propane is condensed. At the outlet of heat exchanger 41 it has a pressure of about 20 bars and a temperature of about 60° C. The propane finally undergoes expansion when passing through the expansion valve 21 and at the outlet of this valve has a pressure of 4 bars and a temperature of about 0° C.

The butane circulating in the fourth closed circuit 39 has a pressure of 4 bars and a temperature of about 50° C. at the inlet to heat exchanger 41. It is vaporised when passing through this exchanger and at the outlet has a pressure of 4 bars and a temperature or about 240° C. The butane is then compressed by the compressor 45 to a pressure of 19 bars and a temperature of about 310° C. It is condensed when passing through heat exchanger 43 and has a pressure of about 19 bars and a temperature of about 116° C. at the outlet of heat exchanger 43. The butane then undergoes expansion when passing through the expansion valve 47 to a pressure of 4 bars and a temperature of about 50° C. The butane flow-rate in the fourth closed circuit is about 52 t/h.

The flow-rate of hexane in the second closed circuit 23 is about 50 t/h. It has a pressure of 2.5 bars and a temperature of 110° C. at the inlet to heat exchanger 43. The hexane is vaporised in heat exchanger 43 and has a pressure of 2.5 bars and a temperature of 305° C. at the outlet of exchanger 43. The hexane is then compressed by the compressor 27 to a pressure of 15 bars and a temperature of 365° C. The hexane is condensed on passing through heat exchanger 25 and undergoes expansion when passing through the expansion valve 29.

The water flow-rate in the third closed circuit 9 totals about 65.2 t/h. The water flow-rate in the first loop is about 62 t/h and the water flow-rate in the second loop is about 3.2 t/h. At the inlet 31 to the second heat exchanger, the steam circulating in the first loop has a pressure of 9 bars and a temperature of about 180° C. It is superheated when passing through heat exchanger 25, the steam at the outlet 35 having a pressure of 9 bars and a temperature of about 360° C. The steam is compressed by the compressor 61 to a pressure of 30 bars and temperature of 405° C. The water circulating in the second loop, at the inlet 33 of the second heat exchanger, has a pressure of 30 bars and a temperature of about 180° C. This water is vaporised in heat exchanger 25 to a temperature of about 370° C. and a pressure of about 30 bars. The first and second loops are connected to the same inlet 55 of the turbine. As a variant, they can be connected to different inlets.

The steam drives the turbine and at the same time undergoes expansion. It has a pressure of 9 bars and a temperature of about 180° C. at the low pressure outlet of the turbine.

The steam is subdivided into two flows and is partly directed towards the feedback line 57 of the first loop and partly towards the intermediate line 67 of the second loop.

The steam is at least partly condensed in the intermediate exchanger 65, the pressure and temperature remaining substantially constant. The water at the inlet of the compressor 75 has a pressure of 9 bars and a temperature of 180° C., and at the discharge of said compressor it has a pressure of 30 bars and a temperature of 180° C.

The energy balance of the device is the following: the atmospheric air transfers about 3 700 000 kcal/hour to the propane. The propane receives about 1 660 000 kcal/hour in the intermediate exchanger. At the time of compression by the compressor 19 it also receives about 550 000 kcal/hour. The propane transfers about 5 900 000 kcal/hour to the butane in heat exchanger 41.

The butane then receives about 600 000 kcal/hour at the time of compression by the compressor 45. It transfers about 6 500 000 kcal/hour in exchanger 43.

The hexane receives about 600 000 kcal/hour at the time of compression by the compressor 27. It transfers about 7 000 100 kcal/hour to the water in heat exchanger 25. Also, the water circulating in the first loop receives about 550 000 kcal/hour at the time of compression by the compressor 61. No consideration is given to the energy received by the water circulating in the second loop at the time of compression by compressor 75.

Therefore, the energy provided to the turbine is about 6 000 000 kcal/hour taking into account the heat transferred by the steam of the second loop in the intermediate exchanger 65. The electric yield of the turbo-alternator assembly 11 and 13 is about 70%. The alternator 13 therefore produces about 4 000 200 kcal/hour of electricity i.e. an electric power of 4,900 kW.

The electric consumption of the different compressors 19, 27, 45, 61 and 75 is respectively 750 kW, 900 kW, 900 kW, 800 kW, 20 kW. The consumption of the fans intended to force the circulation of atmospheric air through exchanger 17 is estimated at about 100 kW.

The electricity generating device therefore has a positive energy balance of about 1400 kW.

The electricity generating device described in the foregoing has multiple advantages.

Since this device comprises:

a first heat pump, provided with a first closed circuit in which a first heat-transfer fluid circulates, and with a first heat exchanger between the first heat-transfer fluid and an atmospheric air fluid in which the atmospheric air flow transfers a quantity of heat to the first heat-transfer fluid, at least one second heat pump, provided with a second closed circuit in which a second heat-transfer fluid circulates, and with a second heat exchanger between the second heat-transfer fluid and a third heat-transfer fluid in which the second heat-transfer fluid transfers a quantity of heat to the third heat-transfer fluid;

means for transferring a quantity of heat from the first heat-transfer fluid to the second heat-transfer fluid;

a third closed circuit in which the third heat-transfer fluid circulates;

a turbine inserted in the third closed circuit and driven by the third heat-transfer fluid; and an electric generator mechanically driven by the turbine, the electricity generating device takes heat from the environment, whilst producing electricity. The devices draws advantage from the fact that in heat pumps for every 1 kW of energy applied, in particular for compression of the heat-transfer gas, it is possible to obtain 5 kW of thermal energy. By placing several heat pumps in series, one behind the other, it is possible to raise the temperature of the heat-transfer fluid at each step up to a temperature allowing the production of steam in sufficient quantity to drive the steam turbine coupled with an electric generator. Therefore the fact that several heat pumps in series are used, means that it is possible to overcome the shortcoming of heat pumps i.e. they only allow a small difference in temperature between the flow of absorbed heat and the flow of heat output by the heat pump.

The heat-transfer fluids are chosen so that the condensation temperature of the fluid in a given heat pump substantially corresponds to the boiling temperature of the heat-transfer fluid in the following heat pump of the series.

Therefore, by compressing each heat-transfer fluid with a compressor, then condensing each one by heat exchange with a more volatile fluid, this step being followed by expansion, it is possible to cause the heat of each heat-transfer fluid to be absorbed by the lesser volatile fluid used in the following heat pump of the series. In this way, a progressive increase in the temperature of the heat-transfer fluid is obtained in stages until a temperature of about 400° C. is reached.

Two heat pumps in series may be sufficient to produce electricity, but it is advantageous to use at least three to obtain sufficient energy yield.

The use of propane, butane and hexane as heat-transfer fluids in the three heat pumps placed in series is particularly advantageous since these fluids have characteristics that are well adapted for the targeted objective.

Similarly, the pressure and temperature profiles described above for the heat-transfer fluids of the three heat pumps are particularly well adapted.

By sub-dividing the steam circuit into two loops, with one loop used to superheat the heat-transfer fluid of the first heat pump before compression, it is possible to optimise the total energy yield of the device. The electric yield of the turbine/alternator assembly is therefore higher than 60%, for example of the order of 70%.

The above-described electricity generating device may entail multiple variants.

It may only comprise two heat pumps or three heat pumps, or more than three heat pumps in series one after the other, in relation to the power that is to be obtained and the heat-transfer fluids used.

The heat-transfer fluids used in the different heat pumps may be of any type, provided that the condensation temperature of one heat-transfer fluid used in a given heat pump substantially corresponds to the boiling temperature of the heat-transfer fluid used in the following heat pump of the series.

Also, the pressure and temperature profiles may vary for each of the heat pumps in relation to the thermal power to be transferred and the heat-transfer fluids used.

The water/steam circuit could only comprise a single loop.

The heat exchanger 25 between the second heat-transfer fluid and the water may consist of one exchanger with several zones or may consist of several heat exchangers physically independent of each other.

The invention claimed is:

1. A device for generating electricity, comprising:

a first heat pump comprising a first closed circuit in which a first heat-transfer fluid circulates, and with a first heat exchanger between the first heat-transfer fluid and a flow of atmospheric air in which the flow of atmospheric air transfers a quantity of heat to the first heat-transfer fluid, at least one second heat pump comprising a second closed circuit in which a second heat-transfer fluid circulates, and with a second heat exchanger between the second heat-transfer fluid and a third heat-transfer fluid in which the second heat-transfer fluid transfers a quantity of heat to the third heat-transfer fluid;

a third heat pump configured to transfer a quantity of heat from the first heat-transfer fluid to the second heat-transfer fluid;

a third closed circuit, in which the third heat-transfer fluid circulates;

a turbine inserted in the third closed circuit and driven by the third heat-transfer fluid; and an electric generator, mechanically driven by the turbine;

the third closed circuit comprising first and second loops in which the third heat-transfer fluid circulates, each of the first and second loops having a hot line connecting an outlet of the second heat exchanger with a high pressure inlet of the turbine, the first loop having a first feedback line connecting a low pressure outlet of the turbine with an inlet of the second heat exchanger, the second loop having an intermediate heat exchanger between the first heat-transfer fluid and the third heat-transfer fluid in which the third heat-transfer fluid transfers a quantity of heat to the first heat-transfer fluid, an intermediate line connecting a low pressure outlet of the turbine with an inlet of the intermediate heat exchanger, and a second feedback line connecting an outlet of the intermediate exchanger with an inlet of the second heat exchanger.

2. The device according to claim 1, wherein the third heat pump comprises a fourth closed circuit in which a fourth heat-transfer fluid circulates, a third heat exchanger between the first heat-transfer fluid and the fourth heat-transfer fluid in which the first heat-transfer fluid transfers a quantity of heat to the fourth heat-transfer fluid, and a fourth heat exchanger between the fourth heat-transfer fluid and the second heat-transfer fluid in which the fourth heat-transfer fluid transfers a quantity of heat to the second heat-transfer fluid.

3. The method according to claim 1, further comprising:

circulating a fourth heat-transfer fluid through a fourth closed circuit;

transferring a quantity of heat from the first heat-transfer fluid to the fourth heat-transfer fluid; and transferring a quantity of heat from the from the fourth heat-transfer fluid to the second heat-transfer fluid.

4. The device according to claim 2, wherein the first heat-transfer fluid, at an inlet to the third heat exchanger, has a pressure of between 18 and 22 bars and a temperature of between 220 and 270° C., the first heat-transfer fluid having at an inlet to the first heat exchanger a pressure of between 2 and 6 bars and a temperature of between 0 and 20° C.

5. The device according to claim 2, wherein the fourth heat-transfer fluid, at an inlet to the fourth heat exchanger, has a pressure of between 17 and 22 bars and a temperature of between 290 and 330° C., the fourth heat-transfer fluid having at an inlet to the third heat exchanger a pressure of between 2 and 6 bars and a temperature of between 30 and 70° C.

6. The device according to claim 2, wherein the second heat-transfer fluid, at an inlet to the second heat exchanger, has a pressure of between 13 and 17 bars and a temperature of between 340 and 390° C., the second heat-transfer fluid having at an inlet to the fourth heat exchanger a pressure of between 1 and 5 bars and a temperature of between 90 and 130° C.

7. The device according to claim 1, wherein the first heat-transfer fluid comprises propane.

8. The device according to claim 1, wherein the second heat-transfer fluid comprises hexane.

9. The device according to claim 2, wherein the fourth heat-transfer fluid comprises butane.

10. The device according to claim 1, wherein the third heat-transfer fluid comprises water.

11. The device according to claim 1, wherein the turbine and the electric generator together have an electric yield of more than 60%.

12. A method for generating electricity, comprising:

circulating a first heat-transfer fluid through a first closed circuit so as to exchange heat between the first heat-transfer fluid and a flow of atmospheric air in which the flow of atmospheric air transfers a quantity of heat to the first heat-transfer fluid, circulating a second heat-transfer fluid through a second closed circuit so as to exchange heat between the second heat-transfer fluid and a third heat-transfer fluid in which the second heat-transfer fluid transfers a quantity of heat to the third heat-transfer fluid;

transferring a quantity of heat from the first heat-transfer fluid to the second heat-transfer fluid;

circulating the third heat-transfer fluid through a third closed circuit;

driving a turbine inserted in the third closed circuit by the third heat-transfer fluid; and mechanically driving an electric generator by the turbine;

wherein the third closed circuit comprises first and second loops in which the third heat-transfer fluid circulates, each of the first and second loops having a hot line connecting an outlet of the second heat exchanger with a high pressure inlet of the turbine, the first loop having a first feedback line connecting a low pressure outlet of the turbine with an inlet of the second heat exchanger, the second loop having an intermediate heat exchanger between the first heat-transfer fluid and the third heat-transfer fluid in which the third heat-transfer fluid transfers a quantity of heat to the first heat-transfer fluid, an intermediate line connecting a low pressure outlet of the turbine with an inlet of the intermediate heat exchanger, and a second feedback line connecting an outlet of the intermediate exchanger with an inlet of the second heat exchanger.

* * * * *

UNITED STATES PATENT AND TRADEMARK OFFICE

CERTIFICATE OF CORRECTION

PATENT NO. : 8,624,410 B2
APPLICATION NO. : 13/141057
DATED : January 7, 2014
INVENTOR(S) : Alberto Sardo It is certified that error appears in the above-identified patent and that said Letters Patent is hereby corrected as shown below:

In the Specification,

- Column 1, line 1-2, below "Title", insert --Related Applications

This application is a U.S. National Phase of International Application No.: PCT/FR2009/052615, filed December 18, 2009, designating the U.S., and published in French as WO 2010/070242 on June 24, 2010 which claims the benefit of French Patent Application No. 08 58836 filed December 19, 2008.--.
- Column 1, line 4, above "The Invention", insert --FIELD OF THE INVENTION--.
- Column 1, line 6, below ""electricity.", insert --BACKGROUND OF THE INVENTION--.
- Column 1, line 28, after "pumps.", insert --SUMMARY OF THE INVENTION--.
- Column 1, line 32, after "efficiency.", insert --DETAILED DESCRIPTION OF THE EMBODIMENTS--.

In the Claims,

- Column 9, line 1, change "3" to --12--.
- Column 9, line 1, change "Claim 1" to --Claim 11--.
- Column 9, line 6, in Claim 3, change "from the from the" to --from the--.
- Column 9, line 8, change "4" to --3--.
- Column 9, line 14, change "5" to --4--.
- Column 9, line 20, change "6" to --5--.
- Column 9, line 27, change "7" to --6--.
- Column 9, line 29, change "8" to --7--.

Signed and Sealed this
Twenty-second Day of September, 2015

Michelle K. Lee

Michelle K. Lee
*Director of the United States Patent and Trademark Office*

- Column 9, line 31, change “9” to --8--.
- Column 9, line 33, change “10” to --9--.
- Column 9, line 35, change “11” to --10--.
- Column 10, line 1, change “12” to --11--.